US005579549A

United States Patent [19]

Selman et al.

[11] Patent Number: 5,579,549

[45] Date of Patent: Dec. 3, 1996

[54] MATTRESS CONSTRUCTION WITH SELECTED ZONES OF RELATIVE FIRMNESS AND METHOD

[75] Inventors: Steven T. Selman, Hyde Park; John A. White, Wappingers Falls, both of N.Y.

[73] Assignee: Blocksom & Company, Michigan City, Ind.

[21] Appl. No.: 405,163

[22] Filed: Mar. 16, 1995

[51] Int. Cl.[6] ..... A47C 27/045; A47C 27/05

[52] U.S. Cl. ..... 5/721; 5/727; 427/288; 427/385.5; 427/421; 428/195; 428/196; 428/218

[58] Field of Search ..... 5/478, 475, 464, 5/476, 479; 428/195, 196, 218

[56] References Cited

U.S. PATENT DOCUMENTS

| | | | |
|---|---|---|---|
| 3,652,376 | 6/1972 | Bowden, III | 428/249 |
| 3,873,388 | 3/1975 | Hunter | 5/246 |
| 4,180,877 | 1/1980 | Higgins | 5/263 |
| 4,369,534 | 1/1983 | Wright | 5/263 |
| 4,414,696 | 11/1983 | Weitzel | 5/478 |
| 4,578,834 | 1/1986 | Stumpf | 5/477 |
| 5,319,814 | 6/1994 | Dyer, Jr. | 5/901 |
| 5,461,737 | 10/1995 | Ikeda et al. | 5/475 |

*Primary Examiner*—Alexander Grosz
*Attorney, Agent, or Firm*—Jenner & Block

[57] ABSTRACT

An insulator pad for use in mattresses is provided having selected zones of enhanced firmness. A planar pad (100) of fibrous material has at least one area of enhanced or increased firmness. Adhesive is used to bind the fibrous material. The concentration of adhesive in the enhanced areas of firmness is greater than in other areas.

9 Claims, 3 Drawing Sheets

MATTRESS CONSTRUCTION WITH SELECTED ZONES OF RELATIVE FIRMNESS AND METHOD

FIELD OF THE INVENTION

The invention relates generally to the field of mattresses, and in particular, to mattresses having selected zones of relatively increased firmness.

BACKGROUND OF THE INVENTION

Typical mattresses are composed of a wire inner spring unit, two layers of cushioning materials, and two insulator pads. Generally, the insulator pads are placed within the mattress on the top and bottom of the wire inner spring unit below the cushioning material. The insulator pads serve to protect the cushioning materials from the inner spring unit and also to prevent the cushioning materials from falling into the inner spring unit.

To provide extra comfort and extended wear of mattresses, it would be desirable to provide selected zones of relatively increased firmness within the mattress. Most desirably, the zones of relatively increased firmness are located in the areas of the mattress that are subjected to maximum loading and frequent and substantial wear and use. Desirable areas of relatively increased firmness include the transverse head, center and foot. The center of the mattress is selected as a zone of extra firmness because the center must often bear the most weight during sleeping. The head and foot of the mattress are also selected as zones of extra firmness due to wear from sitting.

One known manner of providing selected zones of firmness in a mattress is to increase the thickness of the cushioning material in the area that is to be reinforced. However, increasing the cushioning materials has proved to be economically not feasible.

Another manner for providing selected zones of firmness in a mattress is to reinforce the wire inner spring unit. Reinforcing the wire inner spring unit is accomplished by increasing coil density or employing heavier spring wire in the selected areas. Increasing the coil density in certain areas has proved to be very costly. Increasing the coil density also adds substantial complexity to the manufacturing process due to the variations caused by adding firmness only in selected areas. The use of heavier spring wire for the inner spring unit adds substantial cost and may compromise other mattress components. For example, heavier spring wire in the areas of frequent use may cause the heavier wire to tear into the insulator pad and eventually into the cushioning materials.

A popular approach to providing extra firmness in a mattress is to employ two insulator pads in the areas where increased firmness is desired. The extra pad is commonly referred to as the crown pad. Use of the crown pad requires extra handling of the crown pad and also extra steps to align the crown pad. In addition, the use of an additional pad adds expense and extra inventory.

From the foregoing, it is readily seen that there is a need for a mattress with selected zones of firmness that is cost effective and easy to manufacture.

SUMMARY OF THE INVENTION

In accordance with the present invention, an improved mattress construction is provided. The mattress, in accordance with the invention, has zones of relatively increased firmness where desired. The zones of relatively increased firmness are provided by incorporating into the mattress a mattress insulator pad having corresponding zones of increased relative firmness.

The mattress construction, in accordance with the invention, provides extended mattress life, increased and lasting user comfort, and decreased wear caused by the inner springs, particularly in areas of maximum loading and use. Moreover, the invention allows for zones of relatively increased firmness where desired. The foregoing advantages can be economically and readily provided in accordance with the mattress and method of the present invention.

In accordance with one aspect of the invention, a planar pad of treated fibrous material is provided having at least one area of enhanced firmness. This area can be in a location as desired, but generally will be either the transverse center portion of the pad or the transverse center and transverse end portions of the pad. The fibrous materials of the mattress pad are coated with adhesive material to bind the fibrous material and to provide firmness. The enhanced areas of firmness, i.e. the stronger areas, are treated with a substantially greater amount of adhesive to produce an insulator pad having selected zones of increased relative firmness. Generally, the amount of additional adhesive in the relatively firmer areas is from about 0.175 to about 0.3 ounces (weight) per square foot of pad, depending on the desired weight of the pad. The pad can be coated with adhesive by spraying fluid adhesive onto the pad and thereafter curing or drying the adhesive.

Alternatively, the less firm zones of the pad can be treated with a first adhesive and the zones having increased firmness can be treated only with a second adhesive that provides increased firmness or in combination with first and second adhesives as long as the desired increased firmness is obtained.

In accordance with the invention, the mattress incorporates the foregoing insulator pad having selected zones of firmness. At the core of the mattress is a wire inner spring unit having a first surface and an opposite second surface. Two insulator pads with selected areas of firmness are used to overlie the first surface and the second surface of the wire inner spring unit. A layer of cushioning material overlies each insulator pad. Finally, a fabric or other suitable cover is used to encase the cushioning materials, the insulator pads and the wire inner spring unit.

In another aspect of the invention, a method is provided for making an insulator pad with selected zones of firmness. According to the method, a quantity of a first adhesive is applied to a batt of fibrous material in the areas where enhanced firmness is desired. Then a quantity of a second adhesive is applied on the entire batt of fibrous material. The batt is then dried, preferably in an oven, and the resulting sheets may be cut into insulator pads having desired areas of relatively increased firmness. Typically, the quantity of first adhesive is in the range of from about 0.175 to about 0.3 ounces (weight) per square foot of insulator pad and the quantity of second adhesive is in the range of from about 0.525 to about 0.9 per square foot of insulator pad.

DESCRIPTION OF THE PREFERRED EMBODIMENTS

Figure 1:
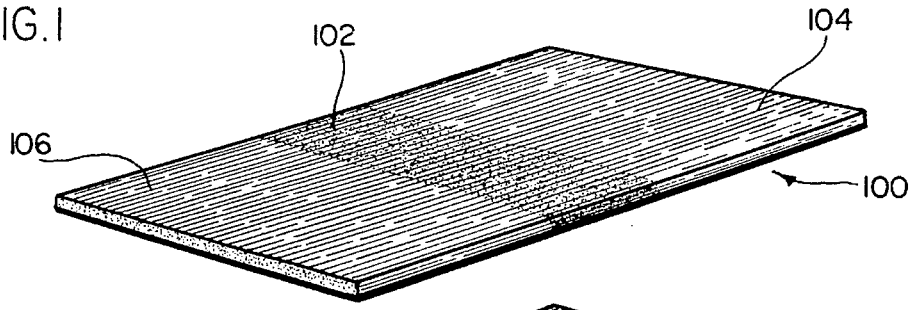
FIG. 1 is a perspective view of an insulator pad with a zone of firmness located in the center in accordance with the present invention.

FIG. 1 illustrates a planar insulator pad 100 having a center portion 102, a head portion 104, and a foot portion 106. Center portion 102 has increased firmness in comparison to head portion 104 and foot portion 106. Pad 100 is comprised of fibrous material that is treated with adhesives for binding. The fibrous material may be any natural or synthetic fiber. Preferably, the fibrous material is an oriented natural fiber such as coconut husk. The fibrous material is needle punched with a loom before being treated with adhesives or binding agents.

In accordance with the present invention, center portion 102 receives an application of a first fluid adhesive. This application of the first adhesive is preferably made via spray nozzles at a desired pressure spaced a predetermined height above the pad, to cover the desired area of the pad with a desired loading of adhesive per unit area of pad, to produce a predetermined degree of firmness in the center portion 102. After the first adhesive is applied in center portion 102, a second fluid adhesive is applied over the entire top and bottom surfaces of insulator pad 100. The second application of adhesive may also preferably be made using spray nozzles at a desired pressure and spaced a predetermined height above and below the insulator pad to produce predetermined degrees of firmness within the insulator pad. After the two applications of adhesives, the pad is dried, preferably with an oven. The variance in concentration of adhesives resulting from the two applications of adhesives produces an insulator pad having a center portion 102 that is firmer than two end portions 104, 106.

Insulator pads are produced with varying weight grades. The weight grades may range from about 1.75 ounces per square foot to 3.0 ounces per square foot. Generally, about 70% of the weight is due to the fibrous material and about 30% of the weight is due to the adhesive. For a preferred embodiment of the present invention, the firmer areas are approximately 10% heavier than the remainder of the pad. For example, for the embodiment shown in FIG. 1, the head portion 104 and foot portion 106 may weigh approximately 2 ounces per square foot and center portion 102 may weigh approximately 2.2 ounces per square foot.

Adhesives for binding fibrous materials into insulator pads for mattresses are well known in the art. In the preferred embodiment of the present invention, the first adhesive and the second adhesive are the same. Using the same mixture for both the first and second application of adhesives eliminates the need to inventory and mix two separate adhesives. However, two different adhesives may alternatively be used.

The preferred adhesive or binding agent is a mixture of water, hydrated aluminum silicate, a dispersion agent, a nonionic surfactant, a surfactant soap, a phosphate, melamine, a synthetic latex emulsion, and a styrene-butadiene polymer dispersion. A 5203 pound mixture of the first adhesive is formed by mixing 1837 pounds of water with five pounds of a dispersion agent. The preferred dispersion agent is NOPCOSPERSE 44, which is sold by Henkel Corporation of Ambler, Pa. Then four pounds of the nonionic surfactant and three pounds of the surfactant soap are added to the mixture. The preferred nonionic surfactant is an alkylphenol-hydroxypolyoxyethylene which is sold under the product name TRITON X-100 SURFACTANT, by Union Carbide Chemicals and Plastics Company, Inc. of Danbury, Conn. The preferred surfactant soap is sodium alkyl sulfate, which is sold under the product name AVIROL SL-2010 by Henkel Corporation. Four pounds of phosphate are added to the mixture. The preferred phosphate is tetrasodium diphosphate, which is commonly known as TSPP and is supplied by FMC Corporation of Philadelphia, Pa. Then 1200 pounds of hydrated aluminum silicate are added to the mixture. The preferred hydrated aluminum silicate is sold under the trade number CHICORA by J. M. Huber, Corporation of Macon, Ga. Then 150 pounds of melamine are added to the mixture before the addition of 800 pounds of synthetic latex emulsion and 1200 pounds of styrene-butadiene polymer dispersion. The preferred melamine is a melamine-formaldehyde resin, which is sold under the name AEROTEX M-3 RESIN by American Cyanamid Company of Wayne, N.J. The preferred synthetic latex emulsion is a blend of butadiene and acrylate copolymer latexes, which is sold under the trade name TYLAC by Reichhold Chemicals, Inc. of Dover, Del. The preferred styrene-butadiene polymer dispersion is sold under the product name STYROFAN 5302 by BASF Corporation of Charlotte, N.C.

The above described adhesive results in a mixture by weight of about 35% water, about 23% hydrated aluminum silicate, about 0.1% dispersion agent, about 0.1% nonionic surfactant, about 0.1% surfactant soap, about 0.1% phosphate, about 3% melamine, about 15% synthetic latex emulsion, and about 23% styrene-butadiene polymer dispersion.

Most preferably, a dye is added to the adhesive that is applied to produce the areas of increased firmness. The dye gives an easily recognizable visual indication of the zones of increased firmness. For example, the addition of blue dye in the first adhesive would result in a blue center portion 102 to distinguish that firmer portion from the end portions 104, 106.

Figure 2:
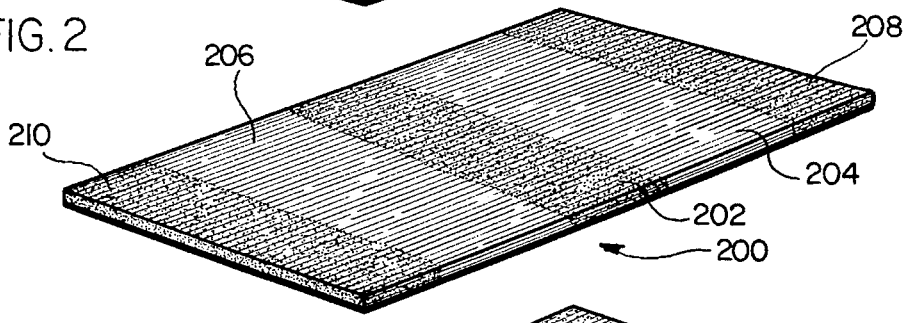
FIG. 2 is a perspective view of an insulator pad with zones of firmness located in the center, head and foot in accordance with the present invention.

FIG. 2 illustrates an additional embodiment of the present invention. An insulator pad 200 has a center portion 202, two middle portions 204, 206, and two end portions 208, 210. Center portion 202 and end portions 208, 210 are enhanced areas of firmness produced in accordance with the principles of the present invention. Center portion 202 is enhanced to support the wear due to sitting and sleeping. End portions 208, 210 support the extra wear caused by sitting. By applying a first adhesive only in center portion 202 and end portions 208, 210 and then applying a second adhesive over entire pad 200, insulator pad 200 with selected zones of firmness is created.

Figure 3:
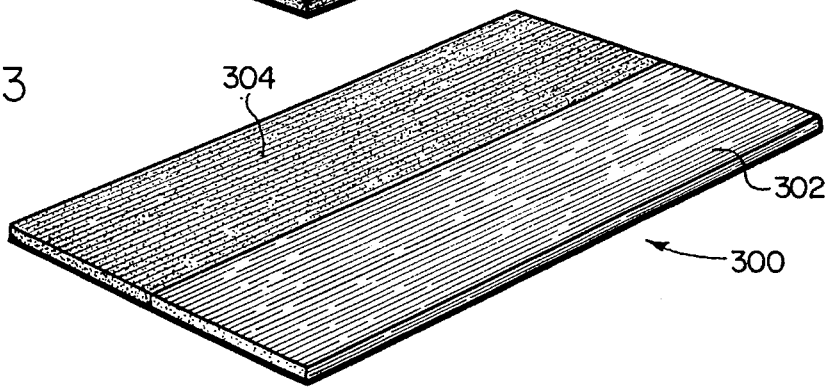
FIG. 3 is a perspective view of an insulator pad with a zone of firmness located in a vertical section of the pad in accordance with the present invention.

FIG. 3 shows an additional embodiment of the present invention. An insulator pad 300 has two vertically divided sections 302, 304. By making two applications of adhesive in section 304 and only one application of adhesive in section 302, insulator pad 300 is created with a vertical section of increased firmness. This embodiment is desirable for a mattress product for use by a couple desiring different degrees of firmness for their respective portions of the bed.

The embodiments of the invention shown in FIGS. 1–3 are preferably produced by two applications of adhesive. The zones of firmness result from higher concentrations of adhesive in the enhanced areas. Those skilled in the art may readily see that higher concentrations of adhesive may be produced in the pad in one application of adhesive or multiple applications of adhesives.

Figure 4:
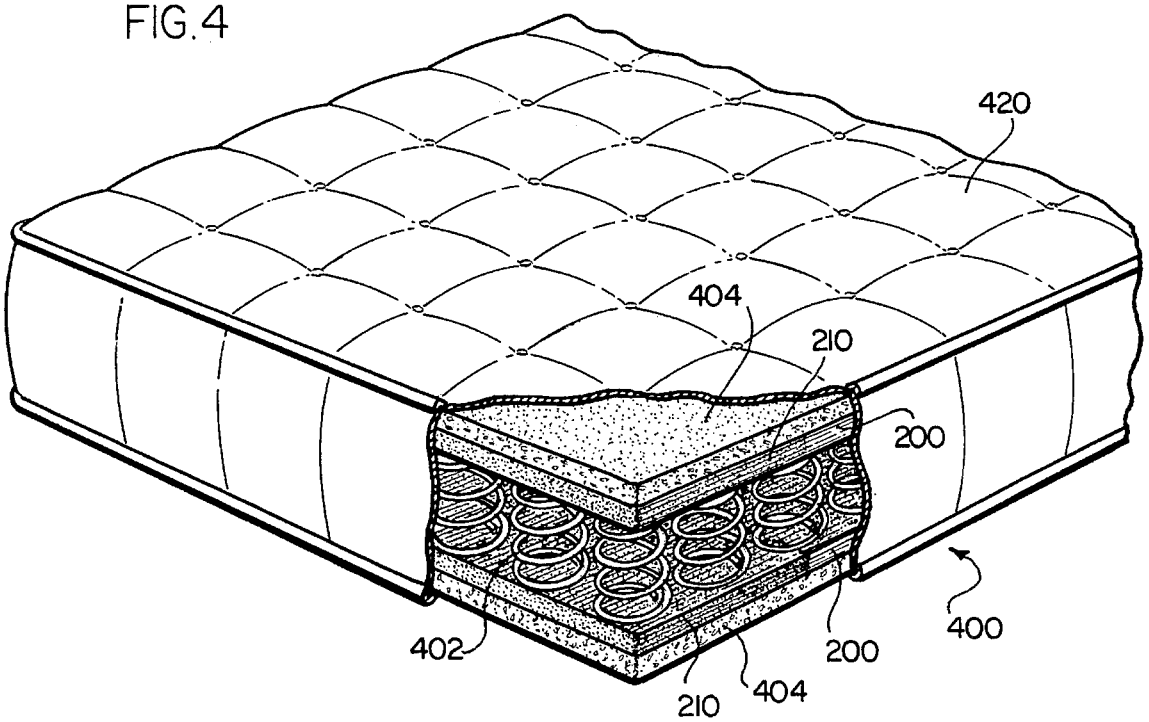
FIG. 4 is a partial cut-away view of a mattress incorporating insulator pads made in accordance with the present invention.

FIG. 4 shows a partial cut-away view of a mattress incorporating insulator pad 200 in accordance with the present invention. The mattress includes a wire inner spring unit 402, two insulator pads 200, two layers of cushioning materials 404, and a fabric cover 420.

At the core of the mattress is wire inner spring unit 402. Inner spring unit 402 provides the primary resilience of mattress 400. On the two opposing surfaces of wire inner spring unit 402 lie two insulator pads 200. Insulator pads 200 have selected zones of firmness. One zone of firmness is shown at end portion 210. Insulator pads 200 protect the layer of cushioning materials 404 from wire inner spring unit 402. Insulator pads 200 also prevent cushioning materials from falling into wire inner spring unit 402. A layer of cushioning materials 404 is provided on top of each insulator pad 200 to provide comfort to the user of the mattress. The cushioning materials may preferably be foam rubber pads. Finally, a fabric cover 420 is used to encase and contain wire inner spring unit 402, insulator pads 200, and layers of cushioning materials 404.

Figure 5A:
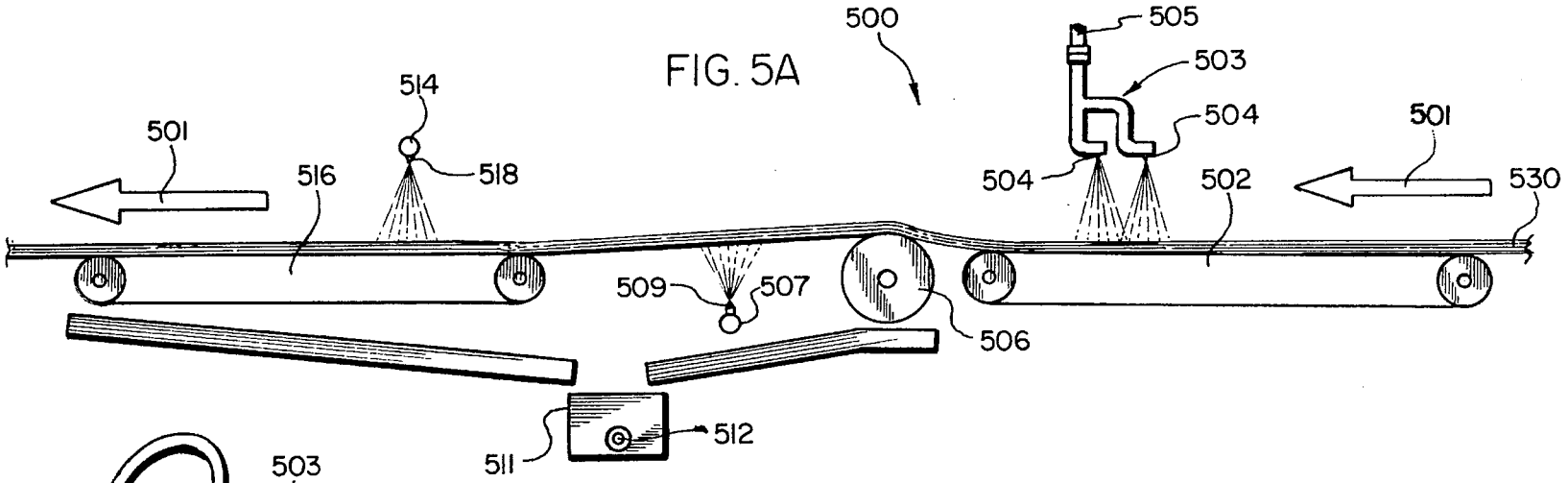
FIG. 5A is a schematic view of an apparatus used for making an insulator pad in accordance with the present invention.
Figure 5B:
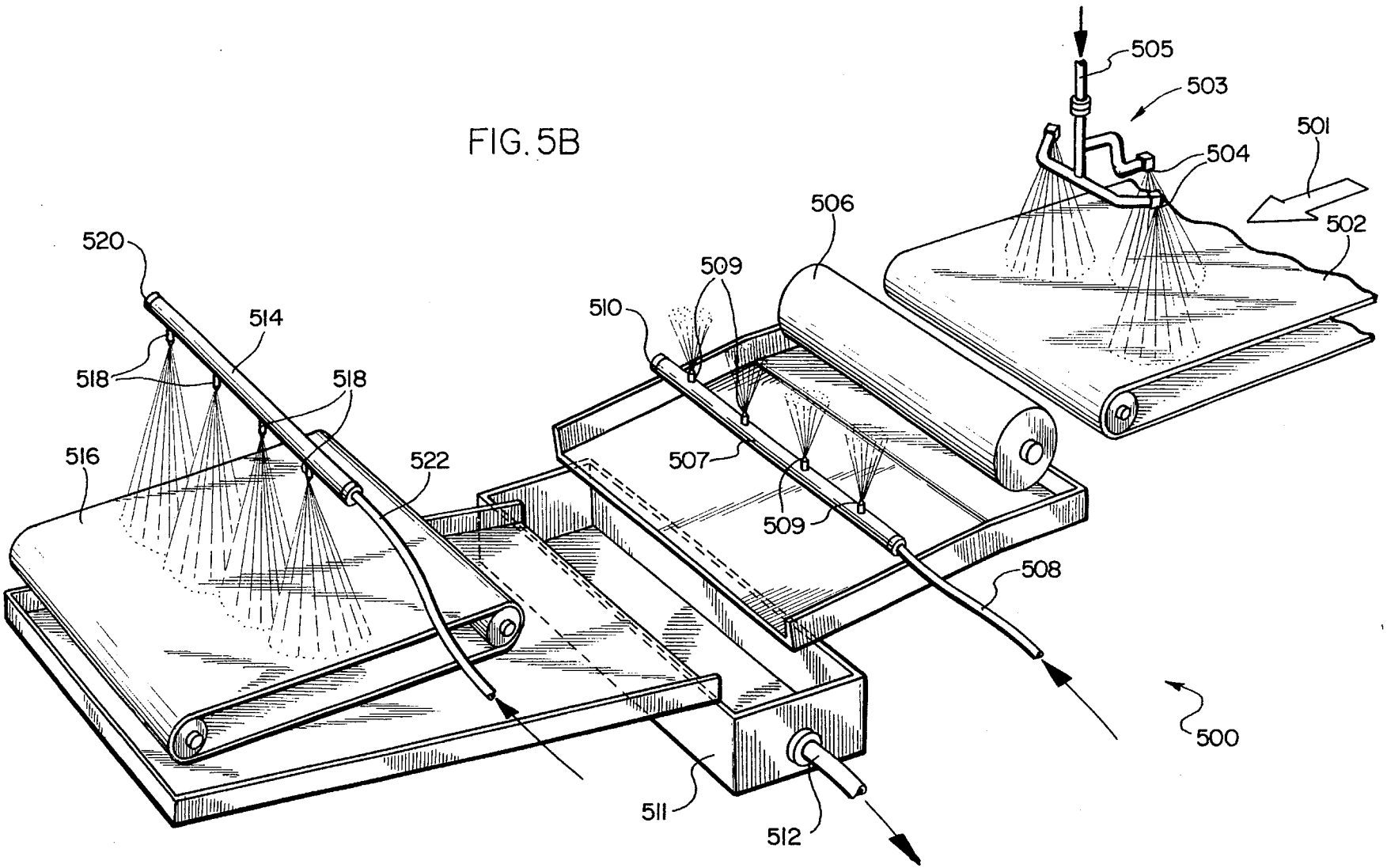
FIG. 5B is a perspective view of the apparatus used for making an insulator pad shown in FIG. 5A.

FIG. 5A and FIG. 5B show in schematic and perspective views, respectively, an apparatus 500 used for making an insulator pad with selected zones of firmness in accordance with the principles of the present invention. Apparatus 500 includes loom output apron 502, which is a conveyor assembly used to supply a batt of fibrous material 530 from the output of a loom (not shown) in the direction of arrow 501. Mounted above loom output apron 502, is a spray manifold 503 with three spray tips 504. Manifold 503 is used to apply an adhesive to batt of fibrous material 530 traveling on loom output apron 502. The adhesive is supplied to manifold 503 via manifold supply line 505. Preferably, spray tips 504 are mounted approximately 10 inches apart from each other, approximately 19 inches above loom output apron 502.

A carrier roll 506 is provided just beyond loom output apron 502. Carrier roll 506 facilitates the travel of the batt of fibrous material 530 throughout the manufacturing process. Mounted below and just beyond carrier roll 506 is a bottom spray assembly 507. Bottom spray assembly 507 applies adhesive to the bottom of batt of fibrous material 530 as it travels past carrier roll 506.

Bottom spray assembly 507 has a supply line 508 that is connected to a holding tank (not shown) that holds adhesive. Bottom spray assembly 507 further includes a pipe 510 that is connected to supply line 508. On pipe 510 are mounted four spray tips 509. Preferably, spray tips 509 provide an 80 ° fan of adhesive at a maximum of 8 gallons per minute. Preferably, the spray tips are mounted approximately 26 inches apart from each other and approximately 19 inches from a point where the surface of batt of fibrous material 530 rests.

A return trough 511 is mounted below and beyond bottom spray assembly 507 for receiving any excess adhesive. A return pump line 512 is provided at return trough 511 to facilitate pumping the adhesive from trough 511 back to a holding tank (not shown) for reuse.

Beyond return trough 511 is mounted an oven input apron 516. Oven input apron 516 is a conveyor assembly that receives batt of fibrous material 530 from carrier roll 506 and supplies it to drying ovens (not shown). Above oven input apron 516 is mounted a top spray assembly 514. Top spray assembly 514 sprays adhesive on the top of batt of fibrous material 530.

Top spray assembly 514 receives adhesive from a supply line 522. Supply line 522 is attached to a holding tank (not shown) that holds the adhesive. The supply line 522 feeds a pipe 520. Mounted on pipe 520 are four spray tips 518. Preferably, spray tips 518 supply adhesive at an 80° fan at a maximum of 8 gallons per minute. Preferably, spray tips 518 are mounted approximately 26 inches apart from each other and approximately 19 inches above a point where batt of fibrous material 530 rests on the oven input apron 516.

Figure 6:
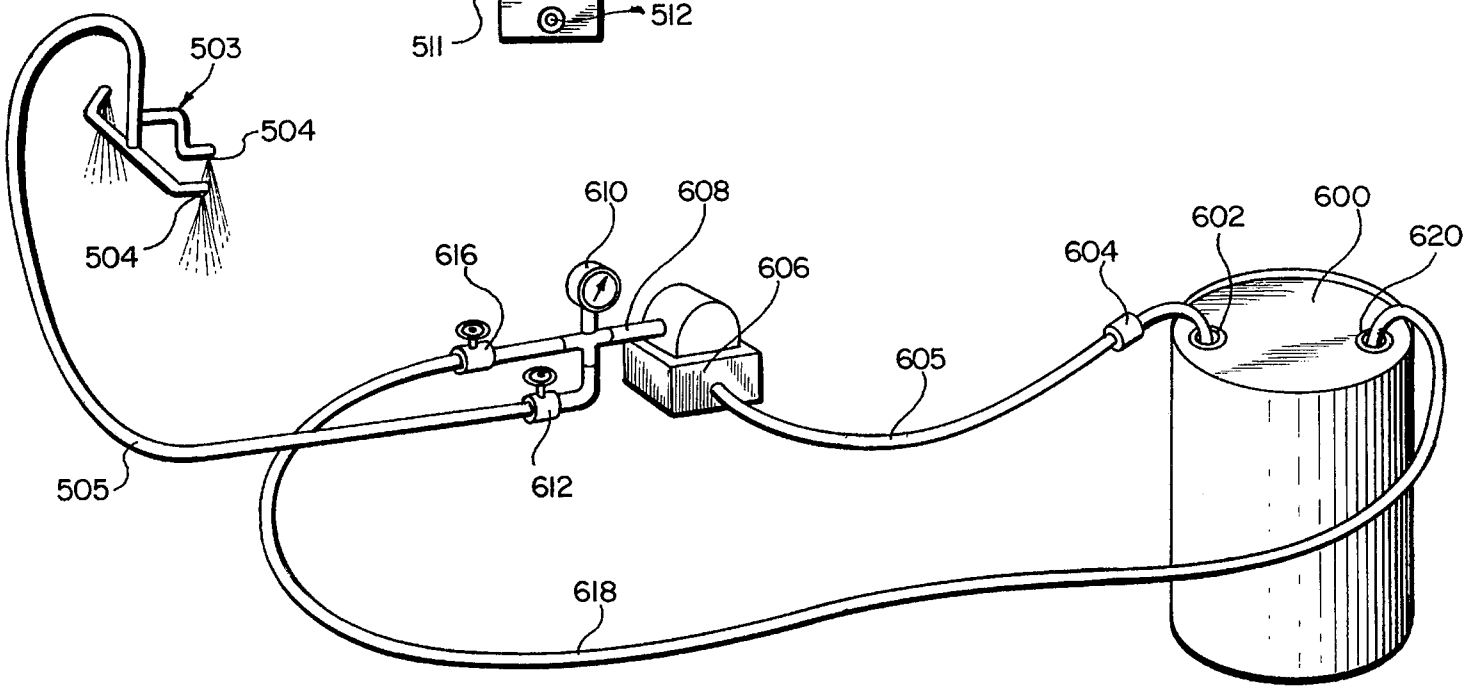
FIG. 6 is a bypass loop system used to supply adhesive to the apparatus shown in FIGS. 5A–B.

FIG. 6 shows the by-pass loop system used to supply adhesive to the manifold 503. A drum 600 is used to hold the adhesive. At an output 602 of the drum 600 is provided a Y-screen 604. Y-screen 604 filters solids from the adhesives. Adhesives are supplied to a pump 606 via a pump intake line 605. Pump 606 outputs the adhesive to a pressure gauge 610. Attached to separate outputs of pressure gauge 610 are a manifold ball valve 612 and a return pump ball valve 616. Manifold ball valve 612 controls the supply of adhesive to manifold 503. Return line ball valve 616 controls the flow of adhesive through a return line 618 to the input 620 of the drum 600.

The apparatus shown in FIGS. 5A–B and FIG. 6 operate in concert to produce an insulator pad with selected zones of firmness. Needle punched batt of fibrous material 530 is supplied from a loom (not shown) onto loom output apron 502. Loom output apron 502 moves the fibrous material 530 in the direction of the arrow 501. Preferably, loom output apron 502 moves the fibrous material 530 forward at about 80 to 88 ft/min.

As the selected areas of firmness approach the spray manifold 503, spray manifold 503 must be made operational. With both manifold ball valve 616 and return line ball valve 612 open, the return line ball valve 612 may be slowly closed to produce a desired pressure in manifold supply line 505, as reflected by the pressure gauge 610. Preferably, the pressure should be maintained at 80–85 pounds per square inch while the spray manifold 503 is in operation. Spray manifold 503 is in operation, i.e., spraying adhesive, until the selected area of firmness passes spray manifold 503. Then spray manifold 503 is shut off by opening return line ball valve 616 and closing manifold ball valve 612. The adhesive then recirculates through drum 600 via return line 618. By selectively operating the spray manifold 503, the enhanced areas of firmness receive an application of adhesive.

Bottom spray assembly 507 continuously sprays adhesive. Top spray assembly 514, similarly, sprays adhesive continuously. As fibrous material 530 passes over and beyond carrier roll 506, the bottom of fibrous material 530 is sprayed with adhesive from bottom spray assembly 507. Similarly, as fibrous material 530 is transported down oven input apron 516, the top of fibrous material 530 is sprayed with adhesive. Any over spray or excess drains into return trough 511 for reuse throughout the system.

Bottom spray assembly 507 and top spray assembly 514 apply adhesive consistently over the entire batt of fibrous material. Spray manifold 503 is selectively turned on and off to only apply adhesive in the selected zones of firmness. The resulting pad has different concentrations of adhesive as a result of the variations in applications of adhesive.

The invention described herein is an improvement over prior art methods of creating enhanced areas of firmness in mattresses. The present invention eliminates the extra expense and inventory associated with crown pads and eliminates the cost and complexity associated with reinforcing the wire inner spring unit.

While the invention has been described with respect to preferred embodiments, it should be understood that various modifications can be made to the invention without departing from the spirit of the invention or the scope of the appended claims.

What is claimed is:

1. A mattress comprising:

a wire inner spring unit having a first surface and an opposed second surface;

two insulator pads of Fibrous materials, each having at least one predetermined first zone coated with adhesive to provide a desired degree of firmness and at least one predetermined second zone coated with adhesive to provide a degree of firmness greater than the firmness of the first zone, and wherein the first insulator pad overlies the first surface of the wire inner spring unit and the second insulator pad overlies the second surface of the wire inner spring unit;

two cushioning pads, wherein the first cushioning pad overlies the first insulator pad and the second cushioning pad overlies the second insulator pad; and a fabric cover that overlies the two cushioning pads and contains the two cushioning pads, the two insulator pads and the wire inner spring unit.

2. The mattress of claim 1 wherein each insulator pad is coated with a first adhesive and the second zone is coated with additional adhesive.

3. The mattress of claim 2 wherein the first and additional adhesives comprise water, hydrated aluminum silicate, a dispersion agent, a nonionic surfactant, a surfactant soap, a phosphate, melamine, a synthetic latex emulsion, and a styrene-butadiene polymer dispersion.

4. The mattress of claim 2 wherein the first and additional adhesives are the same and comprise water, hydrated aluminum silicate, a dispersion agent, a nonionic surfactant, a surfactant soap, a phosphate, melamine, a synthetic latex emulsion, and a styrene-butadiene polymer dispersion and the second zone contains at least about 33% more adhesive than the first zone per unit area.

5. The mattress of claim 2, wherein the additional adhesive is different from the first adhesive.

6. The mattress of claim 2, wherein one of the first and additional adhesives contains a dye to permit visual identification of the area of the pad to which that adhesive has been applied.

7. The mattress of claim 1 wherein the first zone is impregnated with about 0.525 to 0.9 ounces of adhesive per square foot of pad and the second zone is impregnated with about 33% more adhesive.

8. The mattress of claim 1 wherein the predetermined second zone includes a center portion of the insulator pad.

9. The mattress of claim 1 wherein the predetermined second zone includes a head portion and a foot portion of the insulator pad.

* * * * *